US005080757A

United States Patent [19]

Fagerlund

[11] Patent Number: 5,080,757

[45] Date of Patent: Jan. 14, 1992

[54] METHOD TO DISPLACE A DIGESTER FROM BOTH ENDS

[75] Inventor: Bertil K. E. Fagerlund, Ponte Vedra, Fla.

[73] Assignee: Beloit Corporation, Beloit, Wis.

[21] Appl. No.: 706,613

[22] Filed: May 29, 1991

Related U.S. Application Data

[62] Division of Ser. No. 429,876, Oct. 30, 1989.

[51] Int. Cl.[5] ..... D21C 7/00; D21C 7/08

[52] U.S. Cl. ..... 162/37; 162/52; 162/41

[58] Field of Search ..... 162/52, 241, 239, 242, 162/248, 249, 41, 37; 422/110, 242, 295

[56] References Cited

U.S. PATENT DOCUMENTS 2,179,796 11/1939 Morterud ..... 162/251
3,881,986 5/1975 Backlund ..... 162/19
4,248,662 2/1981 Wallick .
4,578,149 3/1986 Fagerlund .
4,690,731 9/1987 Hartler et al. .

FOREIGN PATENT DOCUMENTS 2526060 11/1983 France .
8501305 3/1985 World Int. Prop. O. .

OTHER PUBLICATIONS

Abstract Bulletin of the Institute of Paper Chemistry, vol. 53, No. 8, Feb. 1983, p. 978.

*Primary Examiner*—Karen M. Hastings
*Assistant Examiner*—Brenda Lamb
*Attorney, Agent, or Firm*—Dirk J. Veneman; Raymond W. Campbell

[57] ABSTRACT

An apparatus and method for use in a batch digesting process to quantitatively displace fluids in the digester by pumping into the digester under pressure a first volume of displacing fluid at the upper end and a second volume of displacing fluid at the lower end of the digester. Displaced fluids are collected and removed form the digester near the midline between the top and the bottom of the digester.

7 Claims, 1 Drawing Sheet

METHOD TO DISPLACE A DIGESTER FROM BOTH ENDS

This is a divisional of copending application(s) Ser. No. 07/429,876 filed on 10/30/89.

BACKGROUND OF THE INVENTION i. Technical Field

The present invention relates to an improvement in methods and apparatus for the batch digesting of cellulosic material such as wood chips, and more particularly to a process and apparatus for conserving the sensible heat contained in black spent liquor at the end of a digestion process.

ii. Prior Art

In conventional batch processes for digesting wood chips, the digester is filled with chips and the digester is then charged with a cooking chemical which in a soda process comprises essentially a solution of sodium hydroxide, and in a kraft process, comprises such a solution with a further inclusion of sulfur compound. The digester is then sealed and, with steam, the temperature of the digester is brought up to cooking temperature at which it is maintained for a period of time. At the conclusion of the cook, a blow valve in the digester is opened, and the contents of the digester is discharged into a blow tank by virtue of the hot liquor therein flashing into steam and forcing the delignified pulp out of the digester.

Much of the heat energy acquired by the contents of the digester during the processing exits through the blow tank with exhaust vapors. To recover such heat energy, attempts have been made to pass such vapors through various forms of heat recovery systems. Many of these recovery systems have not been efficient and, to conserve energy costs, some pulp manufacturers have chosen to install continuous digestion processes. A continuous process is quite distinctive from a batch digestion process, but usually has a more efficient utilization of heat than is achieved by a conventional batch process. However, the cost of equipment needed in a continuous process is normally substantially greater than the cost of equipment required in a batch type process, and the characteristics of the pulp obtained may differ.

Various arrangements have been proposed utilizing batch type processes which effect an energy saving such as those proposed in my U.S. Pat. Nos. 4,578,149 and 4,601,787. In the modified batch processes, at the end of a cook, the digester is held under pressure, and displacement liquids are used to displace the hot cooking liquors under pressure and substantially at cooking temperatures. Two or three accumulators are used to store the displaced cool, hot, and warm liquors in the three accumulator systems. During subsequent digester fills, the liquors in the accumulators are pumped to the digester to displace air and to preheat and pretreat the chips. All liquor fills are done by displacement. In the previously known displacement techniques, the displacing fluid is pumped into the bottom of the digester and the displaced fluid flows out the top of the digester.

An object of the present invention is to provide an improved method and apparatus which utilizes the advantages of a batch type process and which effects an increase in thermal energy saving over the more conventional batch processes.

A further object of the invention is to provide an improved batch type digester cooking system which employs a displacement concept of emptying the black spent liquor at the end of the digestion process and which effects a saving in time for removing the liquor at the end of the process.

A still further object of the invention is to provide a process wherein batch type cooking is employed and the black liquor is removed at the end of the cooking process by adding a displacement liquid wherein intermixing of displacement liquid and hot black liquor is diminished in order to conserve the high temperature of the spent liquor.

FEATURES OF THE INVENTION

In accordance with the concepts of the invention, an apparatus and method are employed wherein a digester is filled with wood chips and with cooking liquor, and at the end of the cooking process, the black spent liquor is removed and retained in a reservoir at a high temperature and a superatmospheric pressure and thereafter used to heat and pretreat chips in a second digester to conserve the sensible heat and residual chemicals within the black liquor. The black liquor is removed and transferred to the reservoir under pressure by pumping in a lower temperature displacement liquid both in the bottom and in the top of the digester. The spent high temperature black liquor is removed at a mid-portion of the digester, being pushed out by the two columns of lower temperature liquid approaching from the top and from the bottom. Displacement during subsequent digester fills is handled in a similar manner.

With this arrangement, the displacements are done in a minimum amount of time. At the front of the approaching displacing liquid, where it is pushing the displaced liquid ahead of it, a certain amount of intermixing occurs. The depth of this interface or amount of intermixing is minimal since the distance along which the interface travels is reduced over conventional displacement techniques, and, by pushing the displaced liquid from both directions, the total time required for displacement is reduced. Also, while there are two interfaces between the displaced and the displacing liquids, the depths of the interfaces are reduced.

Another feature resulting from the arrangement of the dual displacement directions is attributable to the reduced cycle time, in that there is an optimum time of cook for the delignification process. When the cooking time has been completed, it is desirable to terminate the cooking reactions quickly, so as to not overcook the wood chips. The reduction in time for displacement by the cooler liquor has a further advantage in that any reduction in time which may be accomplished in the whole process increases the total output capacity of the system in a mill.

Blowing can be accomplished by removal of all of the black liquor and discharging the contents by conventional means such as steam pressure from the top, by utilizing air admitted to the top of the digester to blow the delignified pulp out of the bottom end or, more preferably, by pumping the contents out of the digester.

With displacement liquid being added from both ends, the pulp at both the upper and lower ends receives essentially the same amount of washing in the digester, and, throughout the digester, a greater uniformity in washing within the digester occurs.

Other objects, advantages and features will become more apparent with the teaching of the concepts of the invention in connection with the disclosure of the preferred embodiments in the specification, claims and drawings, in which:

DESCRIPTION OF THE DRAWING

The single Figure of the drawing labeled

DESCRIPTION OF THE PREFERRED EMBODIMENTS

Figure 1:
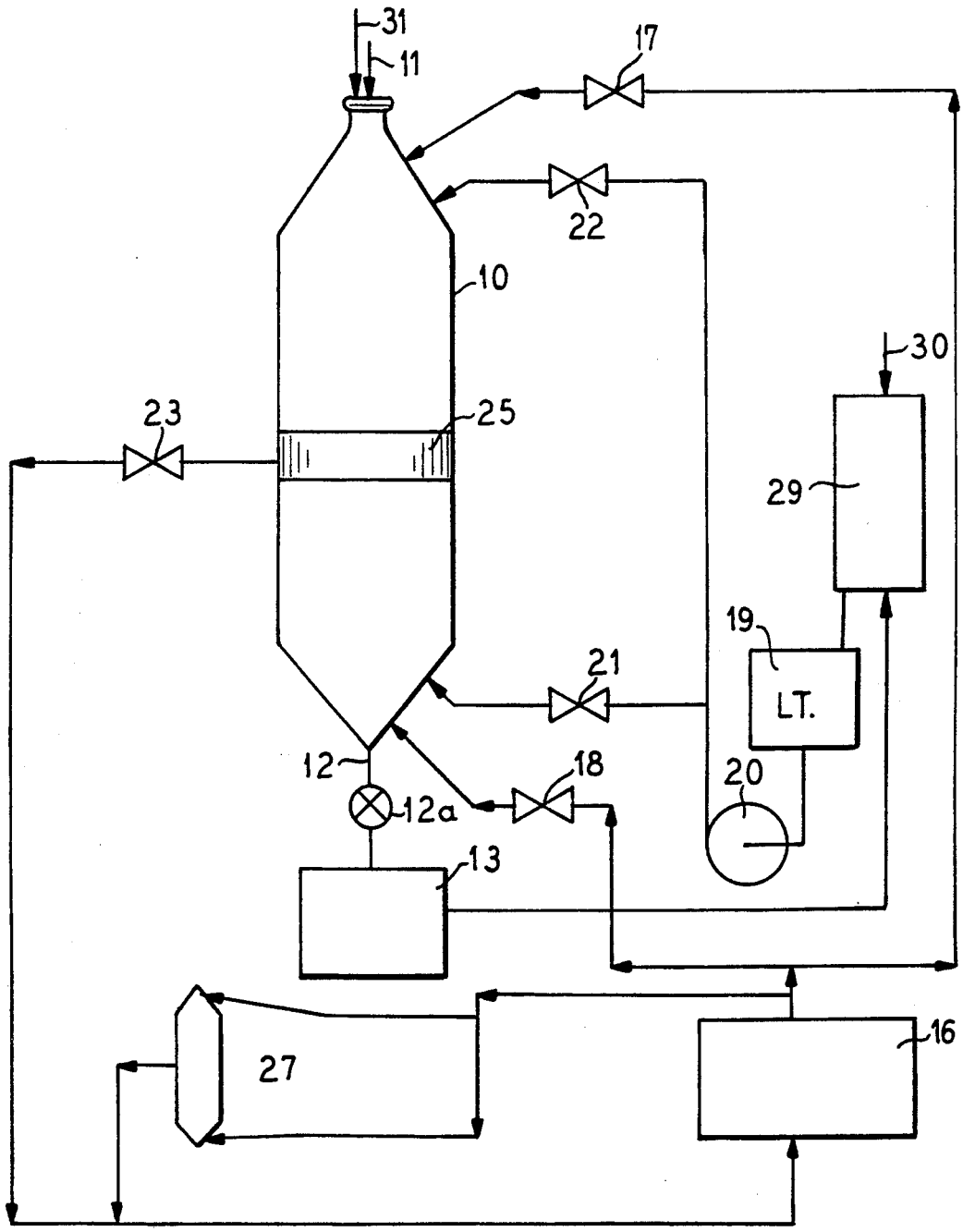
FIG. 1 is a schematic illustration of a digester system constructed and operating in accordance with the principles of the present invention.

In a batch type process, it is typical to charge a digester with wood chips, and then introduce into the digester a reactive liquor including a reactive chemical. In the case of the soda process, the reactive liquor known as white liquor is essentially an aqueous solution of liquor which includes a sulfur compound. Digestion occurs with the contents of the digester at elevated temperature and pressure, the temperature within the digester typically being within the range from 330° to 350° F. (165° to 177° C.). At the conclusion of the cooking cycle, the reactive liquor is referred to as black liquor or spent liquor, which is at digester temperature and still contains residual active chemicals.

In accordance with the present invention, at the conclusion of a cooking cycle, and while maintaining the pressure in the digester, a displacement liquid which preferably may be filtrate from a pulp washing cycle, is pumped into both ends of the digester. A first volume of this lower temperature liquid is pumped in to the top and a second volume of lower temperature liquid is pumped into the bottom of the digester to displace the hot black liquor. The hot black liquor leaves the digester through an outlet at the center of the digester, and is passed to a reservoir or accumulator at the temperature and pressure of the digester. Additional displacements may be utilized to further cook and wash the chips. The total volume of each displacement fluid need not equal the black liquor volume. For example, third and fourth volumes pumped into the top and bottom respectively may result in additional hot spent liquor being displaced out of the digester.

When a digester is subsequently filled, chips are added to the digester with suitable packing such as with steam or air nozzles are arranged to emit pressurized fluid against the chips entering the digester. Upon completion of the fill, the digester is pumped hydraulically full of lower temperature washer filtrate typically utilized as a displacement liquid in a previous digester cycle. This fill forces air from the digester, and initially treats and slightly warms the chips. In a three-stage displacement heating process, this fill will be performed with liquor from a cool black liquor accumulator. The cool black liquor is displaced from the digester utilizing warm black liquor from another liquor accumulator, with a following displacement occurring with hot black liquor and thereafter cooking liquors. In each of the displacements, whether at the beginning or at the end of the cooking cycle, the displacing fluid is pumped into both the top and bottom of the digester, with the displaced fluid being removed intermediate the digester ends. Normally, the separate displacements from the top and from the bottom are performed at nearly the same time; however, in some situations it may be desirable to delay one or the other.

In the particular apparatus utilized for carrying out the method of the invention, the drawing shows a digester 10. In the beginning of the digesting cycle, pretreated chips are inserted into the digester at 11 and are packed such as with steam or air for maximum volume. At the lower end of the digester is an opening 12 with a valve **12*a* which is opened at the completion of the digestion and displacement process for blowing or pumping the pulp into a blow chamber 13**.

To begin the cooking process, preliminary heating may be achieved with cool, warm and hot black liquor from a tank farm 16. The tank farm 16 includes a plurality of accumulators. As is well-known to those versed in the art, and as shown in my previously identified U.S. patents, suitable accumulators will be provided for the cool and hot black liquors and perhaps additionally the warm black liquor. Suitable valve control means 17 and 18 are provided so that all displacement liquids are controllably provided at both the top and bottom of the digester. The control means may be typical flow control valves, allowing control of the start, termination and rate of displacement at each end separately. Following completion of the displacements to preheat and pretreat the chips, the chips are subjected to the cooking process, with the digester being sealed and maintained at the predetermined cooking temperature for a predetermined period of time. Additional heating devices such as heat exchangers may be provided as will be recognized by those versed in the art.

At the completion of the cooking cycle, the pressure and temperature within the digester are maintained, and cool displacement liquid is pumped into the top and bottom of the digester, with the low temperature liquid being obtained from a low temperature tank 19 and being forced into the digester by a pump 20 through control lines having valves 21 and 22. As the lower temperature liquid, which is preferably obtained from the pulp washer, is pumped into the digester, it advances upwardly from the bottom and downwardly from the top of digester 10, thereby forcing the hot spent black liquor out through a line and a valve 23 into a high temperature accumulator in the tank farm 16. The high temperature black liquor is used subsequently to preheat chips in another digester as schematically indicated at 27. It will be recognized by those skilled in the art that the digester 27 typically will be similar in size and operation to the digester 10. While separate inlets are shown for the liquids from the low temperature tank 19 and the tank farm 16 at each the top and bottom of the digester, it will be recognized that separate lines with valves from each may use a common inlet in the digester, so that single fluid inlets are provided at the top and at the bottom of the digester.

The digester 10 has a screen 25 at mid-portion between the top and bottom of the digester. The hot black liquor or other fluid displaced in the digester leaves, through screen 25, the screen preventing the escape of pulp. As the displacement liquid progresses in the digester, moving upwardly from the bottom of the digester and moving downwardly from the top toward screen 25 and the displaced liquid leaves, an interface will be formed between the advancing fronts of the displacing liquid, which may be separately collected from the hot spent black liquor. Thus it can be seen that the displacement liquid and displaced liquid are collected and further processed separately with respect to one another.

Blowing of the digester at the completion of the cook may be accomplished by the insertion of pressurized steam, air or other fluid at a top inlet 31. The admission of fluid will continue until all of the pulp has been forced into the blow pit 13. Alternatively, a pump associated with valve 12*a* and blow pit 13 can be used for evacuating the digester. The fibers in the blow pit will be delivered to a washer 29 which has an admission of wash water 30. The washing liquid, having picked up some heat from the hot fibers is delivered to a low temperature tank 19 to be used as displacement liquid in the next successive batch cooking process. The low temperature tank 19 may be a part of tank farm 16. Usually a plurality of digesters will be used and operated in sequential batch cooking processes, so that the wash liquid from one digester will be used for successive digesters as was the case in using the hot black liquor from the accumulators in the tank farm 16 for successive digesters such as illustrated at 27.

Thus, it will be seen that I have provided an improved and simplified relatively rapidly operating process which is capable of reducing the loss of thermal energy and reducing air pollution by the removal of the black liquor from the pulp before it is blown. Various changes may be made without departing from the scope of the present invention.

I claim:

1. In a batch digesting process wherein a digester is charged with a mass of cellulosic material and digesting liquor, and the charge is then cooked at an elevated temperature and superatmospheric pressure to obtain within said digester a column of delignified pulp and hot spent liquor, the process comprising:

after digestion of said cellulosic material and while maintaining said column of delignified pulp substantially intact, quantitatively displacing the hot spent liquor under pressure by pumping into a top end of said digester a first volume portion of a lower temperature liquid at the top of said column and by pumping into a bottom end of said digester a second volume portion of said lower temperature liquid at the bottom of said column of the digester, forcing hot spent liquor out of the digester at a location intermediate the ends while maintaining said hot spent liquor at said elevated temperature and superatmospheric pressure; and transferring said displaced hot spent liquor under pressure to a second mass of cellulosic material to thereby conserve and utilize the sensible heat of said hot spent liquor to preheat said second mass of cellulosic material.

2. In a batch digesting process wherein the digester is charged with a mass of cellulosic material and digesting liquor and the charge is then cooked at an elevated temperature and superatmospheric pressure to obtain within said digester a column of delignified pulp and hot spent liquor, the process of claim 1:

wherein said first and second volumes are less than the total volume of hot spent liquor within the digester.

3. In a batch digesting process wherein the digester is charged with a mass of cellulosic material and digesting liquor and the charge is then cooked at an elevated temperature and superatmospheric pressure to obtain within said digester a column of delignified pulp and hot spent liquor, the process of claim 1:

wherein third and fourth volumes of displacement fluids are pumped into the top and bottom digester ends, respectively, the total of said first, second, third, and fourth volumes being substantially equal to the volume of hot spent liquor within the digester, so that substantially all of the hot spent liquor is removed by displacement.

4. In a batch digesting process wherein the digester is charged with a mass of cellulosic material and digesting liquor, and the charge is then cooked at an elevated temperature and a superatmospheric pressure to obtain within said digester a column of delignified pulp and hot spent liquor, the process of claim 1:

wherein said first volume portion of lower temperature liquid and said second volume portion of said lower temperature liquid are pumped into the top and bottom ends respectfully of said digester simultaneously.

5. In a batch digesting process wherein the digester is charged with a mass of cellulosic material and digesting liquor, and the charge is then cooked at an elevated temperature and superatmospheric pressure to obtain within said digester a column of delignified pulp and hot spent liquor, the process of claim 1:

wherein said transferring of said displaced hot spent liquor under pressure to a second mass of cellulosic material is performed by pumping said displaced hot spent liquor in separate volume portions to the top and to the bottom of a mass of non-digested chips contained in the same or another batch digester.

6. In a batch digesting process for removing lignin from cellulose material wherein quantitative displacements are utilized for removing liquids from the digester, the improvement comprising:

pumping displacement fluid into the digester at both the top and bottom of the digester;

removing displaced fluid from the digester substantially midway between an upper end of the digester and a lower end of the digester and; collecting and further processing the displaced fluid separately from the displacement fluid.

7. The improved process as defined in claim 6, further including pumping the displacement fluid into the top and into the bottom of the digester substantially simultaneously.

* * * * *